United States Patent [19]

Lane

[11] 4,300,796

[45] Nov. 17, 1981

[54] ADJUSTABLE DOOR AND WINDOW SECURITY PROP

[76] Inventor: John L. Lane, 117 Franklin St., Clarksville, Tenn. 37040

[21] Appl. No.: 98,476

[22] Filed: Nov. 29, 1979

[51] Int. Cl.[3] ..... E05C 17/30

[52] U.S. Cl. ..... 292/339

[58] Field of Search ..... 292/262, 305, 338, 339, 292/352

[56] References Cited

U.S. PATENT DOCUMENTS

| | | | |
|---|---|---|---|
| 17,887 | 7/1857 | Newton | 292/352 |
| 598,405 | 2/1898 | Williams | 292/339 |
| 1,008,790 | 11/1911 | Curlett | 292/352 |
| 1,332,473 | 3/1920 | Shirley | 292/339 |
| 4,036,518 | 7/1977 | Jost | 292/339 |
| 4,176,870 | 12/1979 | Cracraft | 292/338 |

*Primary Examiner*—Richard E. Moore

*Attorney, Agent, or Firm*—Harvey B. Jacobson

[57] ABSTRACT

First and second elongated large and small diameter tubular members rotatably and telescopically engaged with each other are provided. The first and second members include exposed remote ends with one of the remote ends including a terminal end structure adapted to frictionally engage a floor surface and the other remote end includes a terminal end adapted to engage the shank portion of the doorknob. The large diameter elongated member is provided with a pair of diametrically opposite parallel outwardly opening first slots formed therein and the small diameter elongated member is provided with longitudinally spaced pairs of corresponding second slots with which the first pair of slots are selectively registrable. The adjacent marginal edges of the legs of a U-shaped lock structure are receivable through the first slots and in the pair of second slots with which the first slots are registered for releasably locking the large and small diameter members against relative rotation and relative longitudinal shifting. The lock structure is anchored to the exterior of the large diameter tubular member through the utilization of an elongated flexible tether member.

6 Claims, 6 Drawing Figures

ADJUSTABLE DOOR AND WINDOW SECURITY PROP

BACKGROUND OF THE INVENTION

Various forms of doors and windows are not provided with locks while other doors and windows include ineffective locks. One means of assuring a reasonably tightly locked door or window is to provide a prop structure therefore. The prop structure may be inclined relative to and engaged against a doorknob of a horizontally swingable door, horizontally disposed and abutted against the side of a horizontally slidable door or window which is advanced when the door or window is shifted to an open position, and interposed between the upper edge of the inner window of a double hung window and the under surface of the upper frame of the double hung window. However, various doors and windows of these types require props of different lengths. Accordingly, a need exists for an adjustable length door and window prop which may be utilized to prop various types of doors and windows against being opened.

Examples of previously known door and window props including some of the general structural and operational features of the instant invention disclosed in U.S. Pat. Nos. 190,392, 219,098, 324,083, 467,589, 468,987, 598,405, 825,810, 3,583,743, 4,019,765, 4,036,518 and 4,136,899, as well as Canadian Pat. No. 1,019,016 and West German Pat. No. 1,067,392.

BRIEF DESCRIPTION OF THE INVENTION

The prop structure of the instant invention includes a pair of relatively telescoped elongated tubular cylindrical members with the outer tubular cylindrical member provided with diametrically opposite outwardly opening parallel slots and the inner tubular member including longitudinally spaced pairs of similar slots with which the first mentioned slots are selectively registrable. A generally U-shaped lock structure is provided including a pair of elongated legs interconnected at one pair of corresponding ends by a bight portion extending and secured therebetween and the adjacent side marginal portions of the legs are receivable through the first mentioned slots and in the second mentioned slots registered therewith. By such construction, the tubular members may be locked in adjusted extended positions and against relative rotation relative to each other.

The main object of this invention is to provide a longitudinally adjustable door and window prop which may be utilized to prop various sizes and types of doors and windows in the closed positions.

Another object of this invention is to provide an adjustable length prop of lightweight construction.

Still another object of this invention is to provide an adjustable length prop including novel lock structure for locking the prop against longitudinal foreshortening from the desired adjustable length thereof.

A final object of this invention to be specifically enumerated herein is to provide an adjustable length door and window prop accordance with the preceding objects and which will conform to conventional forms of manufacture, be of simple construction and easy to use so as to provide a device which will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
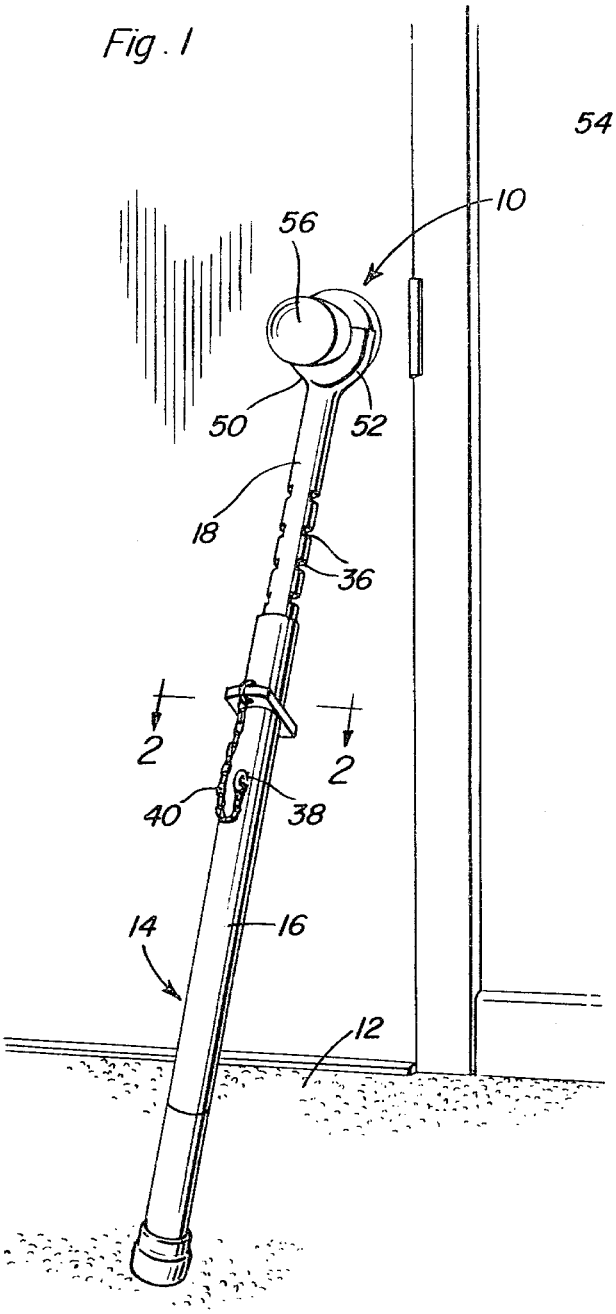
FIG. 1 is a fragmentary perspective view of a horizontally swingable doorknob equipped door with the prop of the instant invention operatively associated therewith in order to prop the door against being swung toward the open position.
Figure 3:
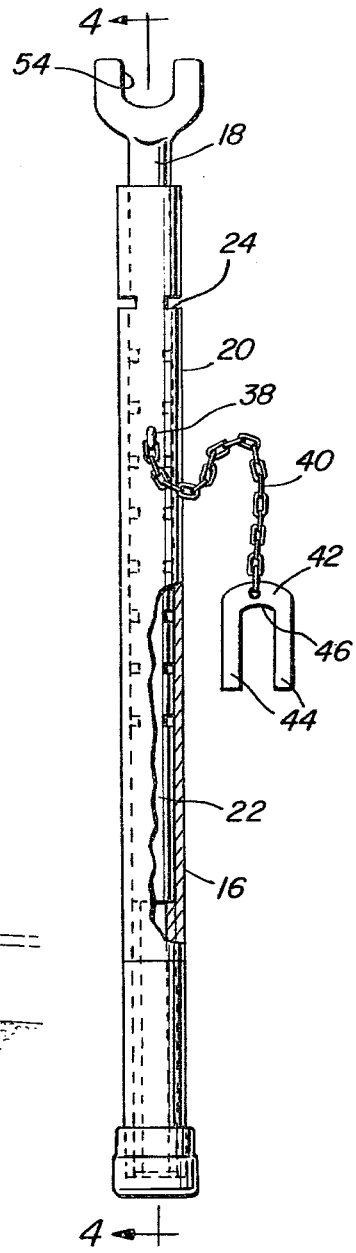
FIG. 3 is an enlarged elevational view of the door and the window prop with portions thereof being broken away and illustrated in vertical sections.
Figure 4:
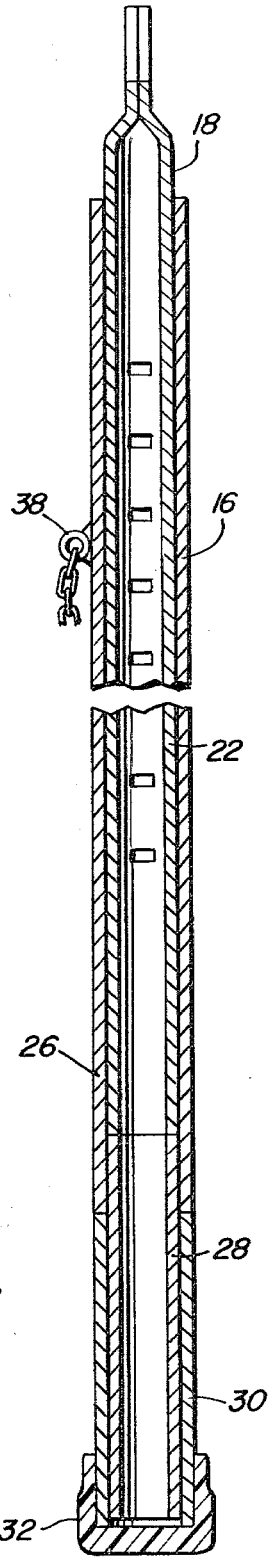
FIG. 4 is a fragmentary enlarged vertical sectional view taken substantially upon the plane indicated by the section line 4—4 of FIG. 3.

Referring now more specifically to the drawings, the numeral 10 generally designates a horizontally swingable door illustrated in the closed position and which is swingable over a floor surface 12 toward an open position.

The prop of the instant invention is referred to in general by the reference numeral 14 and includes first and second large and small diameter tubular members 16 and 18 including adjacent relatively telescoped ends 20 and 22. The end 29 is provided with a pair of diametrically opposite parallel outwardly opening slots 24 formed therein for a purpose to be hereinafter more fully set forth and the remote end 26 of the member 16 has a short small diameter tube 28 partially telescoped thereinto and secured within the end 26. The tube 28 is of substantially the same outside diameter as the tubular member 18 and a tubular foot 30 is telescoped over the exposed end of the tube 28 and abutted against the adjacent end 26 of the tubular member 16, the foot 30 extending only a slight distance beyond the outer end of the tube 28 and having a resilient end cap 32 disposed thereover. The tube 28 may be slightly deformed so as to enjoy a friction fit with the inner surfaces of the foot 30, whereas the inner tubular member 18 enjoys a free sliding fit within the tubular member 16.

Figure 5:
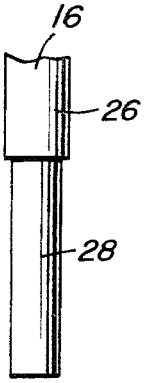
FIG. 5 is a fragmentary enlarged elevational view of the lower end of the large diameter tubular member illustrating the manner in which the lower end is structured to receive a replaceable extension foot member thereover.
Figure 6:
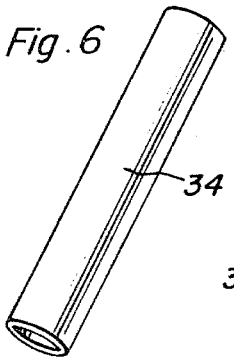
FIG. 6 is a fragmentary perspective view of a predetermined length foot member to be utilized in conjunction with the structure illustrated in FIG. 5 for increasing the effective length the door and window prop.

From a comparison of FIGS. 5 and 6 of the drawings, it may be seen that the foot 30 may be removed and replaced by a longer foot 34 whenever desired in order to effectively increase the length of the prop 14. Also, the length of the longer foot 34 is precisely determined as will be hereinafter more fully set forth.

The inner tubular member 18 is provided with longitudinally spaced pairs of diametrically opposite outwardly opening slots 36 corresponding to the slots 24 and with which the slots 24 may be selectively registered.

Figure 2:
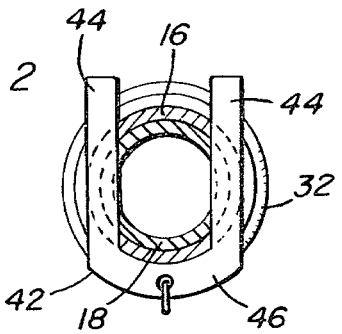
FIG. 2 is an enlarged horizontal sectional view taken substantially upon a plane indicated by the section line 2—2 of FIG. 1.

An anchor member 38 is attached to the outer tubular member 16 intermediate its opposite ends and has one end of an elongated flexible tether member 40 anchored relative thereto. The other end of the flexible tether member 40 has a U-shaped lock 42 anchored relative thereto. The lock 42 includes a pair of parallel legs 44 interconnected at one pair of corresponding ends by a bight portion 46 to which the tether member 40 is anchored. The adjacent longitudinal edge portions of the legs 44 of the lock 42 are slidably receivable in the slots 24 and also the pair of slots 36 with which the slots 24 are registered. By placement of the lock 42 in position with the adjacent longitudinal margin edges of the legs 44 received through the slots 24 and in corresponding slots 36 in the manner illustrated in FIG. 2 of the drawings, the outer and inner tubular members 16 and 18 are locked against relative rotation and also against relative longitudinal shifting.

The free end 50 of the tubular member 18 remote from the end 22 thereof is transversely flattened as at 52 and provided with and endwise outwardly opening U-shaped notch 54.

In operation, the prop 14 may be adjusted to the desired length and thereafter have the notch 54 engaged beneath the shank of the doorknob 56. The cap 32 may then be engaged with the floor 12 and the prop 14 will thus prevent opening of the door 10.

The notched end 52 may also be engaged with any form of lock structure or latch bar which projects outwardly of the side of the door to which the latter is swung toward an open position and the prop 14 may also be utilized to prop double hung windows and sliding windows against being opened. Still further, the prop 14 may be further utilized to prop sliding doors against being opened.

The foot 34 is of a length greater than the length of the foot 30 equivalent to one or more times the distance between adjacent pairs of slots 36 plus one-half the distance between pairs of adjacent slots 36. Accordingly, the adjustability of the length of the prop 14 in predetermined lengths is effectively doubled by providing the foot 34 for utilization in lieu of the foot 30.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A door prop including first and second large and small diameter elongated relatively telescoped and rotatable tubular members, said large and small diameter tubular members including remote first ends, the first end of said large diameter tubular member including a resilient abutment surface engaging end piece supported therefrom, the first end of said inner tubular member including means defining an endwise outwardly opening notch for engaging a doorknob shank from below, said outer tubular member including first lateral opening means therein and said inner tubular member including longitudinally spaced second lateral opening means therein with which the first opening means is selectively registrable, a lock member insertable through the first opening means and the second opening means with which the first opening means is registered to thereby lock said large and small diameter tubular members against relative rotation and longitudinal shifting relative to each other, said large diameter tubular member including a tube partially telescoped and secured in the end thereof remote from the end from which said small diameter tubular member projects, an elongated tubular foot member removably telescopingly engaged over the exposed end of said tube and abutted against the adjacent end of said large diameter tubular member, the end of said tubular foot corresponding to the outer exposed end of said tube having said resilient end piece supported therefrom.

2. The combination of claim 3 including an elongated tether member extending between and anchored relative to said U-shaped lock member and said large diameter tubular member on the exterior thereof.

3. A door prop including first and second large and small diameter elongated relatively telescoped and rotatable tubular members, said large and small diameter tubular members including remote first ends, the first end of said large diameter tubular member including a resilient abutment surface engaging end piece supported therefrom, the first end of said inner tubular member being transversely flattened and provided with an endwise outwardly opening notch, said outer tubular member including a pair of diametrically opposite parallel outwardly opening slots formed therein and said inner tubular member including longitudinally spaced pairs of corresponding slots formed therein with which the first mentioned slots are selectively registrable, a U-shaped lock member including a pair of parallel legs interconnected at one pair of corresponding ends by means of a bight portion, the adjacent longitudinal edges of said legs being slidingly receivable in the first mentioned slots and the pair of second mentioned slots with which the first mentioned slots are registered to thereby lock said large and small diameter tubular members against relative rotation and longitudinal shifting relative to each other, said large diameter tubular member including a tube partially telescoped and secured in the end thereof remote from the end from which said small diameter tubular member projects, an elongated tubular foot member removably telescopingly engaged over the exposed end of said tube and abutted against the adjacent end of said large diameter tubular member, the end of said tubular foot corresponding to the outer exposed end of said tube having said resilient end piece supported therefrom.

4. The combination of claim 3 including a second tubular foot substantially similar to but slightly longer than the first mentioned tubular foot and for replacing the latter, said second tubular foot being longer than the first mentioned tubular foot an amount equal to a multiple of the spacing between the said pairs of slots plus an amount equal to one-half the spacing between said pairs of slots.

5. The combination of claim 4 wherein said resilient end piece comprises a resilient end cap telescoped over the end of said tubular but remote from said large diameter tubular member.

6. The combination of claim 5 including an elongated tether member extending between and anchored relative to said U-shaped lock member and said large diameter tubular member on the exterior thereof.

* * * * *